US008695801B2

(12) United States Patent
Jensen

(10) Patent No.: US 8,695,801 B2
(45) Date of Patent: Apr. 15, 2014

(54) DEVICE FOR HANDLING OF ROLLS

(75) Inventor: Jörgen Jensen, Ullared (SE)

(73) Assignee: Core Link AB, Falkenberg (SE)

( * ) Notice: Subject to any disclaimer, the term of this patent is extended or adjusted under 35 U.S.C. 154(b) by 1329 days.

(21) Appl. No.: 11/632,472

(22) PCT Filed: Apr. 27, 2006

(86) PCT No.: PCT/SE2006/000509
§ 371 (c)(1),
(2), (4) Date: Jan. 16, 2007

(87) PCT Pub. No.: WO2006/118523
PCT Pub. Date: Nov. 9, 2006

(65) Prior Publication Data

US 2008/0230417 A1 Sep. 25, 2008

(30) Foreign Application Priority Data

Apr. 29, 2005 (SE) ..... 0500987

(51) Int. Cl.
*B65D 85/00* (2006.01)

(52) U.S. Cl.
USPC ..... 206/394; 206/391; 206/395

(58) Field of Classification Search
USPC ..... 206/394, 391, 403–406, 395; 242/570; 229/120.09
See application file for complete search history.

(56) References Cited

U.S. PATENT DOCUMENTS

| | | | | | |
|---|---|---|---|---|---|
| 2,340,116 | A | * | 1/1944 | Ferguson et al. | 242/588.6 |
| 2,737,392 | A | * | 3/1956 | Stokes | 473/189 |
| 2,788,892 | A | * | 4/1957 | Dales | 206/395 |
| 2,936,937 | A | * | 5/1960 | Reynolds | 225/48 |
| 3,079,101 | A | | 2/1963 | Rockstrom | |
| 3,280,987 | A | * | 10/1966 | Steinbock | 211/59.1 |
| 3,622,095 | A | * | 11/1971 | Turner | 242/598.3 |
| 4,122,949 | A | * | 10/1978 | Blatt | 206/303 |
| 5,377,831 | A | | 1/1995 | Crooks | |

FOREIGN PATENT DOCUMENTS

EP 1 314 674 A2 5/2003

OTHER PUBLICATIONS

United States Office Action dated Mar. 14, 2012 in U.S. Appl. No. 12/903,473.
United States Office Action dated May 25, 2012 in U.S. Appl. No. 12/903,473.

* cited by examiner

*Primary Examiner* — J. Gregory Pickett
*Assistant Examiner* — Blaine Neway
(74) *Attorney, Agent, or Firm* — McGinn IP Law Group, PLLC

(57) ABSTRACT

The present invention relates to a device for handling a number of sleeves, preferably paper sleeves, before, during and after rolling up of a paper web each thereon, at least one insert sleeve bent from a rigid material web and having a length substantially corresponding to the total length of the rolls being inserted in the rolls for simultaneous handling thereof, wherein the insert sleeve is polygonal, e.g. triangular, rectangular, etc.

6 Claims, 5 Drawing Sheets

DEVICE FOR HANDLING OF ROLLS

The present invention relates to a device according to the preamble to appended Claim 1.

There is a major need in the art for rationalisation of the handling of rolls for, for example, envelope paper, both before, during and after winding up of the paper webs. It is common that paper webs are rolled up simultaneously on three to four magazine reels and occasionally more, which are packed together to a single package of a width of 500-1000 mm. The rolls which are to be packed together are placed on a loose inner sleeve which is kept in position by means of plugs in the outer ends or sealing by means of an adhesive strip. The inner sleeve may be slotted in order to keep the sleeves in position without sealing at the outer ends. Further, the sleeves may be kept in position, or clamped together, by means of fixedly nailed plastic strips, etc. These different methods entail extensive manual handling because of an expensive handling of the loose inner sleeves. The inner sleeves are bulky and requisite space will be considerable. As a result, the whole of the prior art handling process will be extremely costly.

The task forming the basis of the present invention is to realise a device for more rational handling of both the sleeves and the paper rolls.

This task is solved according to the present invention in that the device disclosed by way of introduction has been given the characterising features in appended Claim 1.

A device according to the present invention makes it possible to a high degree to rationalise the handling of both the sleeves and the finished paper rolls and it is extremely simple to take off the inner sleeve in connection with the conversion of the rolls at the point of use. In that the rigid material web can be handled in the form of a roll and consist, for example, of paper, paperboard or cardboard, it is easy to recycle the insert sleeves and other possible paper waste. Naturally, it is not a particular requirement that the insert sleeve be manufactured of paper, paperboard or cardboard, since the choice of material proper is of minor importance, on condition that it affords sufficient rigidity and that the handling is not impeded. As a result of the present invention, there will thus be realised a device which as good as completely obviates the need of handling of rolls. It is only at the end user where the insert sleeve needs to be handled together with the empty sleeves or rolls.

The present invention will be described in greater detail hereinbelow with reference to the accompanying Drawings.

FIG. 1 schematically shows a perspective view of a number of rolls on an insert sleeve according to the present invention.

Figures 1, 2:
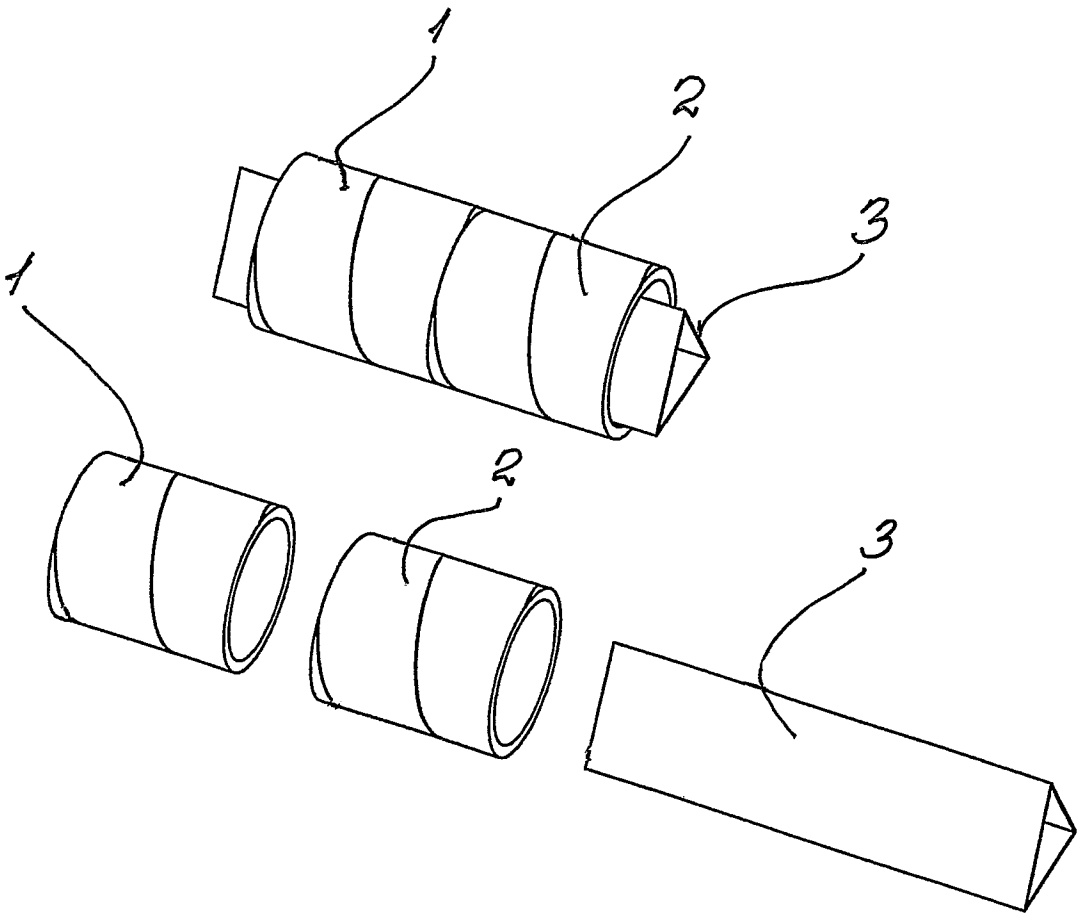
FIG. 2 shows the view illustrated in FIG. 1 with the parts separated.

The device according to one embodiment of the present invention illustrated in FIGS. 1 and 2 consists of two short sleeves 1, 2, on which paper webs are to be wound up, as is common in connection with the handling of, for example, envelope paper webs. The sleeves 1 and 2 are placed on an insert sleeve 3 of triangular configuration. In this instance, it should be observed in particular that the insert sleeve 3 is not intended to be longer than the total length of the sleeves 1 and 2. In FIGS. 1 and 2, the insert sleeve 3 is, however, shown as being longer, but this is merely for purposes of clarification. The insert sleeve 3 is to be of a length which corresponds substantially with the total length of the sleeves 1 and 2. It should further be observed that the number of sleeves 1, 2 is naturally optional. It is common to handle between 3 and 4 sleeves on one and the same insert sleeve 3. In such cases, the total length of the number of sleeves 1, 2 may amount to approx. 500-1000 mm. In this case, the insert sleeve 3 is as long as the sleeves 1, 2 together.

FIG. 2 shows the sleeves 1, 2 before they are placed on the insert sleeve 3. It is naturally simple to place a number, for example 5, of sleeves 1, 2 on a substrate and insert therein an insert sleeve 3, whereafter all sleeves 1, 2 can be handled in an extremely simple manner since they are held together by the insert sleeve 3. The package of sleeves 1, 2 and the insert sleeve 3 may be placed in a paper rolling machine for rolling up of paper webs on the sleeves 1, 2. The package with the insert sleeve 3 and sleeves or paper rolls 1, 2 may thereafter be packed together and transported to a site of use for conversion of the paper rolls into end product.

It is of importance that the insert sleeve 3 be manufactured of a rigid material and the dimensions of the insert sleeve 3 may be such that the insert sleeve 3 has the same, slightly larger or slightly smaller dimension than the inner dimension of the sleeves or rolls 1, 2.

Figures 3, 4:
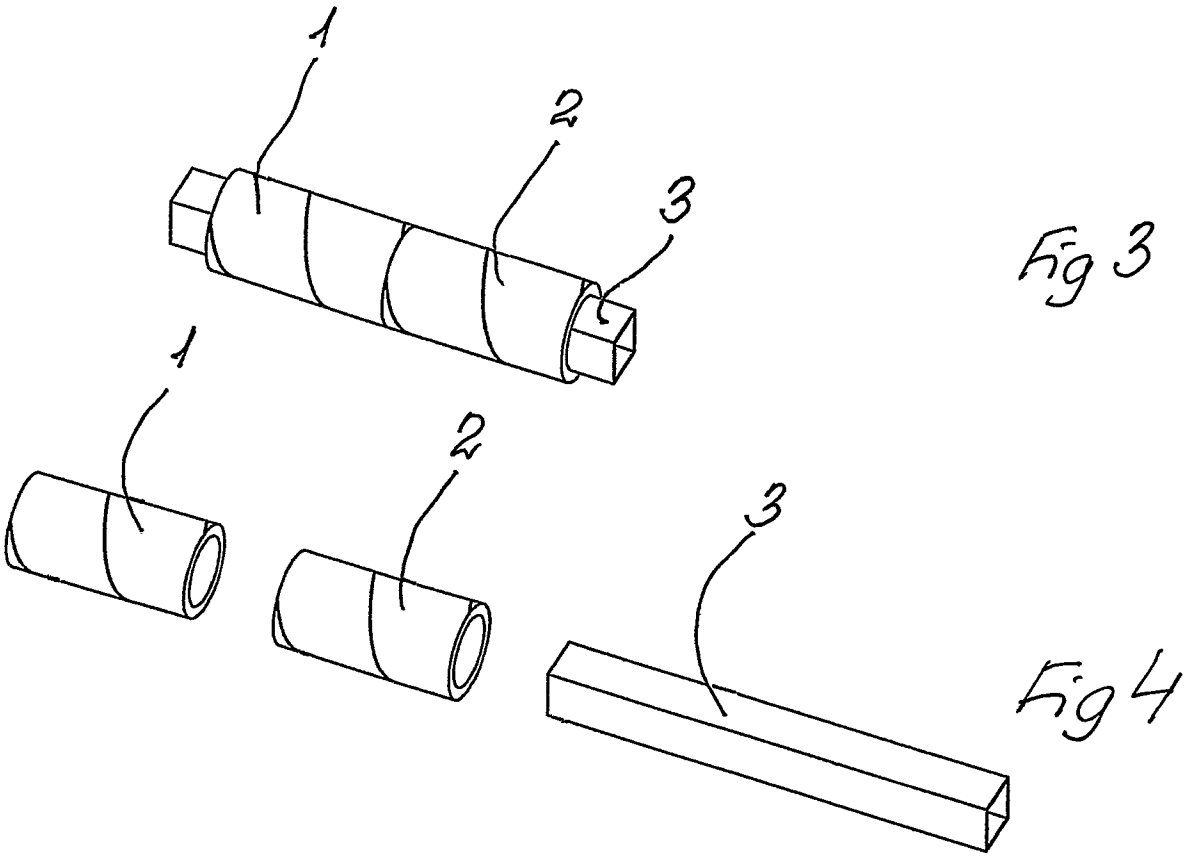
FIG. 3 shows a similar view to that of FIG. 1 with another type of insert sleeve according to the present invention.
FIG. 4 shows a similar view to that of FIG. 2 with the parts illustrated in FIG. 3 separated from one another.

The embodiment of a device according to the present invention shown in FIGS. 3 and 4 corresponds to the form illustrated in FIGS. 1 and 2 apart from the fact that the insert sleeve is rectangular instead of being triangular.

The insert sleeve 3 may be round or polygonal, for example triangular, rectangular, etc. In the case when the sleeve is polygonal, one of the sides may be double-walled, in which event the triangular insert sleeve 3 in FIGS. 1 and 2 has one of its sides double. Between the double walls, it may be appropriate to place a glue strand for securing the walls to one another.

Also in the embodiment illustrated in FIGS. 3 to 4, one of the walls be double and provided with glue strand for securing the walls to one another.

The rigid material web, from which the insert sleeves are manufactured, may advantageously be in the form of a roll, from which the material for the insert sleeves 3 is unwound, creased, cut and thereafter raised and inserted in the sleeves 1, 2. It is highly possible to carry out the creasing after the cutting. In that case where there is a double wall, this may be provided with a glue strand prior to raising into final configuration and insertion in the sleeves 1, 2. It is further possible to cause two meeting walls to overlap one another partly for forming a partial double wall section instead of a complete double wall section, as shown in a part of the Drawing figures.

It is of importance to emphasise that the number of sleeves 1, 2 on an insert sleeve 3 is naturally optional and the invention is naturally not restricted to the number of sleeves 1, 2 described in the foregoing and shown on the Drawings.

Figure 5:
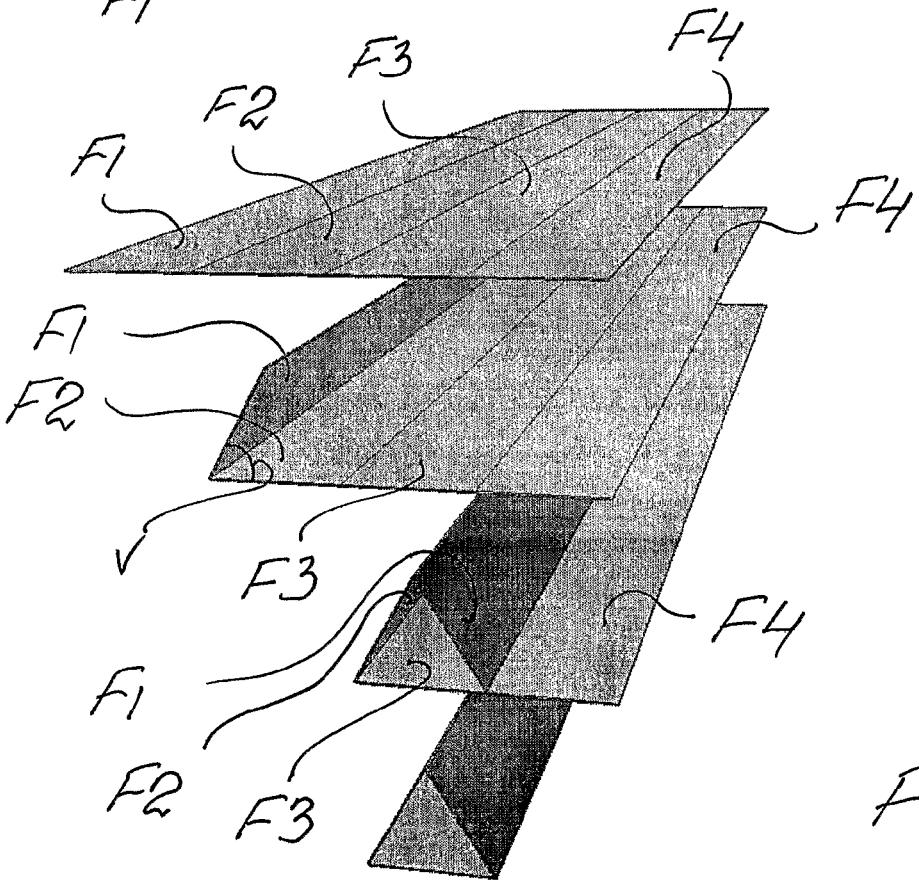
FIG. 5 shows a series of views of how a sheet is bent to a triangular insert sleeve with a double wall according to the present invention.

FIG. 5 shows a blank or a sheet A, which may be cut from a roll or a larger blank or sheet and is divided into a number of fields or panels F1-F4 by means of a number of creases B. The panels are substantially of equal size and the panel F1 is raised or bent for the formation of an angle V in respect of the panel F2, whereupon both panels F1 and F2 are raised or bent against the crease B between the panels F3 and F4 for the formation of a triangular sleeve. The sleeve is completed in that the panel F4 is raised against the panel F1 so that the panels F1 and F4 form a double wall. It is possible to glue the double wall with the aid of one or more glue strands between the panels F1 and F4.

Figure 6:
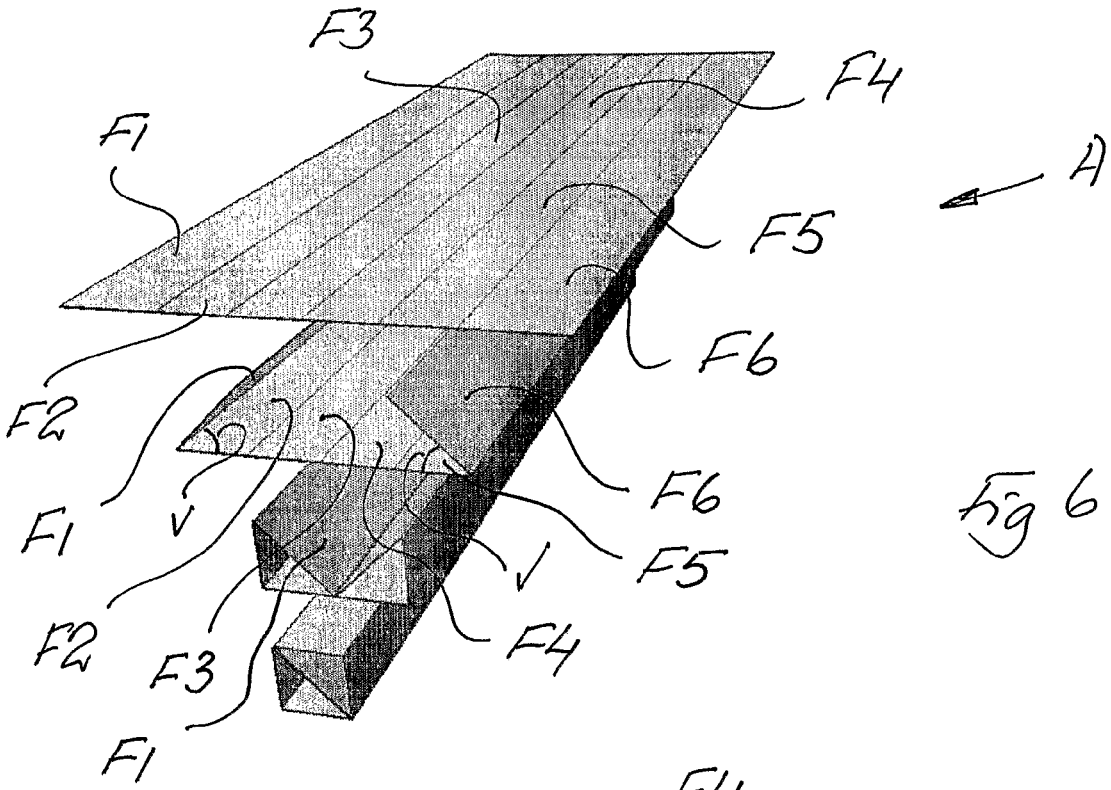
FIG. 6 shows a series of views of how a sheet is bent into a rectangular insert sleeve with double diagonal wall according to the present invention.

FIG. 6 shows a blank or sheet A which, like the sheets in FIG. 5, may be cut from a roll or a larger blank or sheet and is divided into a number of panels F1-F6 by means of a number of creases B. In this embodiment, the panels F1 and F6 are slightly larger than the panels F2-F5, since they are to have the same width as length on the diagonal in the finished rectangular or quadratic sleeve. In this embodiment, the panels F1 and F6 are raised or bent for the formation of the angle V against the panels F2 and F5, so that the outer edges thereof meet in the crease between the panels F4 and F5, whereupon the triangular sleeve sections are raised against one another so that the panels F1 and F6 make a double wall. Also in this embodiment, it is possible to glue the double wall by means of one or more glue strands. It should be observed that gluing may be unsuitable if it is desirable to reuse the insert sleeve. This also applies to the other embodiments with a complete double wall or only a partial double wall.

Figure 8:
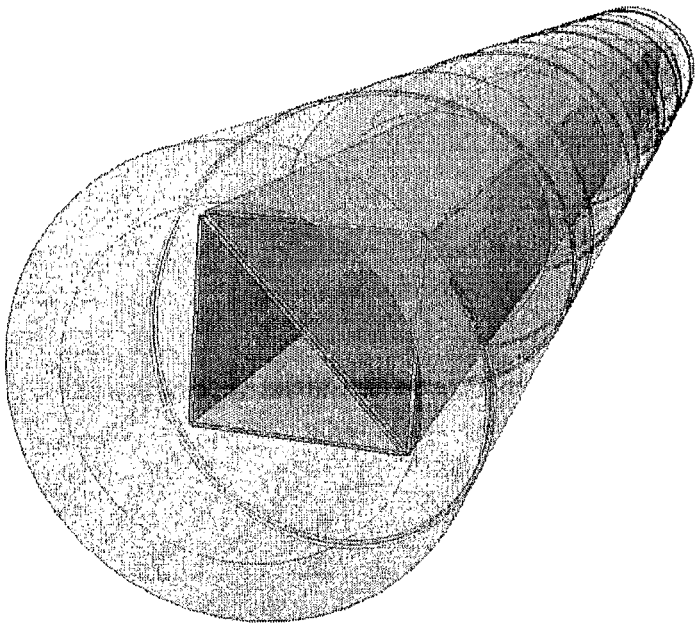
FIG. 8 shows a perspective view of a number of rolls on a rectangular insert sleeve according to the present invention.
Figure 7:
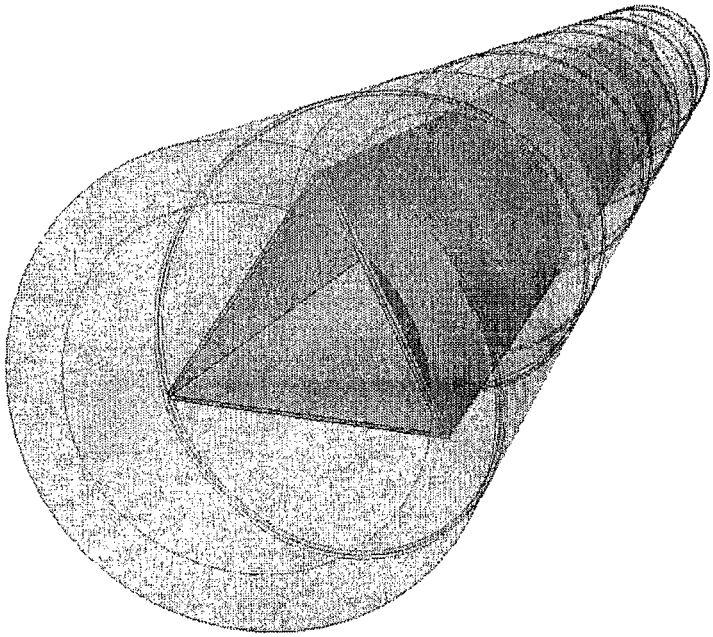
FIG. 7 shows a perspective view of a number of rolls on a triangular insert sleeve according to the present invention.
Figure 9:
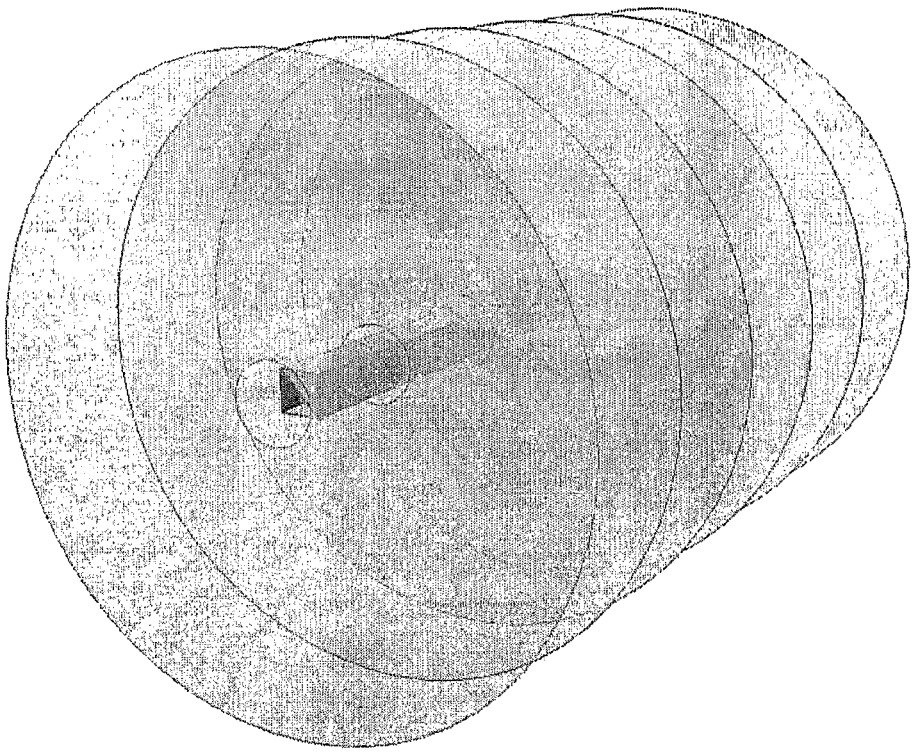
FIG. 9 shows a perspective view of a number of paper rolls on a rectangular insert sleeve according to the present invention.

FIG. 7 shows a number of sleeves on a triangular insert sleeve with a double wall according to the present invention, and in FIG. 8 is shown a number of sleeves on a rectangular or quadratic insert sleeve with diagonal double wall according to the present invention. FIG. 9 shows a number of paper rolls on a rectangular or quadratic insert sleeve according to the present invention. These paper rolls are, as it were, narrow and the handling thereof is facilitated to a great extent by means of the insert sleeve according to the present invention.

It is possible to modify a triangular insert sleeve according to the present invention in such a manner that the outer panels F1 and F4 are creased and dimensioned for the formation of a double wall which extends as a bisector to the angle between the two equally large single-walled panels.

Numerous modifications are naturally possible without departing from the scope of the inventive concept as defined in the appended Claims.

The invention claimed is:

1. An article of manufacture, comprising:

a plurality of sleeves for concurrently rolling up a paper web respectively on each of said sleeves;

an insert sleeve serving as a support core for said plurality of sleeves, before, during, and after said rolling up of said paper web, said support core insert sleeve comprising a rigid material web of a length substantially corresponding to a total length of said plurality of sleeves, as bent into a polygonal shape, when viewed in cross section, and inserted into centers of said plurality of sleeves; and paper web as rolled up respectively on each of said sleeves supported by said support core.

2. The article of manufacture of claim 1, wherein said polygonal shape comprises one of a triangle and a rectangle.

3. The article of manufacture of claim 1, wherein said support core insert sleeve comprises at least one wall that is double-walled.

4. The article of manufacture of claim 3, further comprising a strand of glue disposed to secure at least one of said at least one double-wall.

5. The article of manufacture of claim 3, wherein said at least one wall that is double-walled comprises a diagonal brace in a rectangular cross-sectional support core insert sleeve, as resulting from having two adjacent triangular cross-sectional support core insert sleeves with a common surface providing said double wall.

6. The article of manufacture of claim 3, wherein said at least one wall that is double-walled comprises at least one wall in a triangular cross-sectional support core insert sleeve.

* * * * *